US010173877B2

(12) United States Patent
Kim

(10) Patent No.: US 10,173,877 B2
(45) Date of Patent: Jan. 8, 2019

(54) BOTTLE CAP OPENER

(71) Applicant: Mingu Kim, Seoul (KR)

(72) Inventor: Mingu Kim, Seoul (KR)

( * ) Notice: Subject to any disclaimer, the term of this patent is extended or adjusted under 35 U.S.C. 154(b) by 203 days.

(21) Appl. No.: 15/349,076

(22) Filed: Nov. 11, 2016

(65) Prior Publication Data

US 2018/0037449 A1 Feb. 8, 2018

(30) Foreign Application Priority Data

Aug. 3, 2016 (KR) ..... 10-2016-0099004

(51) Int. Cl.
*B67B 7/18* (2006.01)
*B67B 7/00* (2006.01)

(52) U.S. Cl.
CPC ..... *B67B 7/18* (2013.01); *B67B 7/00* (2013.01); *B67B 2007/188* (2013.01)

(58) Field of Classification Search
CPC ..... B67B 7/04; B67B 7/0417; B67B 7/0441; B67B 7/0447; B67B 7/18; B67B 7/184; B67B 7/44
See application file for complete search history.

(56) References Cited

U.S. PATENT DOCUMENTS 1,081,302 A * 12/1913 Geddis ..... B67B 7/18 81/3.4
2,886,994 A * 5/1959 Hanson ..... A47J 17/04 7/155
4,063,473 A * 12/1977 Bozzo ..... B67B 7/0441 29/434
7,836,793 B2 * 11/2010 Borene ..... B67B 7/18 81/3.29
9,440,834 B2 * 9/2016 Gabriele ..... B67B 7/0441
2010/0187196 A1 * 7/2010 Wasenda ..... B65D 55/00 215/386
2011/0036249 A1 * 2/2011 Barrett ..... A47J 25/00 99/544
2011/0100164 A1 * 5/2011 Mantilla ..... B67B 7/0447 81/3.45
2011/0119835 A1 * 5/2011 Bates ..... B67B 7/0423 7/155
2012/0204683 A1 * 8/2012 Nazikian ..... B67B 1/045 81/3.29
2015/0191336 A1 * 7/2015 Brown ..... B67B 7/0441 81/3.37

* cited by examiner

*Primary Examiner* — David B. Thomas
(74) *Attorney, Agent, or Firm* — Korus Patent, LLC; Seong Il Jeong

(57) ABSTRACT

There is provided a bottle cap opener comprising: a cylindrical body including an upper cylindrical body and a lower cylindrical body; an elongate screw bar passing through the upper cylindrical body at a center thereof, and passing beyond the upper cylindrical body upwards; a handle coupled to the elongate screw bar at a top end thereof; a screw protrusion coupled to the elongate screw bar at a bottom end thereof; both wings pivotally coupled to the upper cylindrical body at both-side pivotal portions thereof via both-side pivotal shafts respectively; and a silicon-based cap gripper formed on an inner face of the lower cylindrical body so as to grip a bottle cap tightly therein.

6 Claims, 6 Drawing Sheets

BOTTLE CAP OPENER

BACKGROUND

Field of the Present Disclosure

The present disclosure relates to a bottle cap opener, and, more particularly, to a screw-type bottle cap opener having a silicon-based gripper.

Discussion of Related Art

A bottle cap opener includes a levering type opener and a screwing type opener. The bottle cap may be soft or may be damaged during the opening. The bottle cap may rotation in vain. A conventional opener may require a considerable handling power.

US 20110036249 discloses a fruit coring system for a fruit such as a coconut having a central cavity therein in which the system consists of a coring assembly and a corkscrew assembly. The coring assembly is a pipe-like segment having a length proportioned to a depth sufficient to reach the central cavity of the fruit, the segment having a serrated first end and an open second end having internal threadings; and lateral hardware attached to and extending from an outer surface of the second end of the pipe-like segment, for facilitating selectable rotation of the pipe-like segment after the corkscrew assembly has positioned the pipe-like assembly upon the fruit to be cored. The corkscrew assembly includes a corkscrew proper; a boss proportioned for threadable engagement with the threaded inner surface of the second end of the pipe-like segment, in which the boss is integral with a second end of the elongate member; and a handle of the corkscrew assembly which is integral to a side of the boss opposite said elongate member. The aggregate length of the entirety of the corkscrew assembly substantially exceeds a length of the coring assembly.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

The present disclosure is to provide a bottle cap opener having a silicon-based cap gripper to so as to grip a bottle cap tightly therein. This silicon-based cap gripper may allow the user to open the cap easily. The silicon-based cap gripper has a threaded inner face.

In one aspect of the present disclosure, there is provided a bottle cap opener comprising: a cylindrical body including an upper cylindrical body and a lower cylindrical body; an elongate screw bar passing through the upper cylindrical body at a center thereof, and passing beyond the upper cylindrical body upwards; a handle coupled to the elongate screw bar at a top end thereof; a screw protrusion coupled to the elongate screw bar at a bottom end thereof; both wings pivotally coupled to the upper cylindrical body at both-side pivotal portions thereof via both-side pivotal shafts respectively; and a silicon-based cap gripper formed on an inner face of the lower cylindrical body so as to grip a bottle cap tightly therein.

In one implementation, the lower cylindrical body is vertically divided into two lower half cylindrical bodies, wherein each of two lower half cylindrical bodies has both vertical edges with engaging convex and concave portions.

In one implementation, the upper cylindrical body has a handle orientation-change groove defined therein, wherein an orientation of the handle changes from a vertical orientation to a horizontal orientation via the handle orientation-change groove.

In one implementation, the handle has the horizontal orientation, the handle is replaced with a L shaped rotation handle including a horizontal portion and a vertical portion coupled thereto.

In one implementation, the silicon-based cap gripper has a threaded inner face.

In one implementation, the both wings are configured such that the pivotal movement of the both wings enables the silicon-based cap gripper to grip the bottle cap tightly therein.

In one embodiment, the screw protrusion extends in a spiral shape.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

Figure 1:
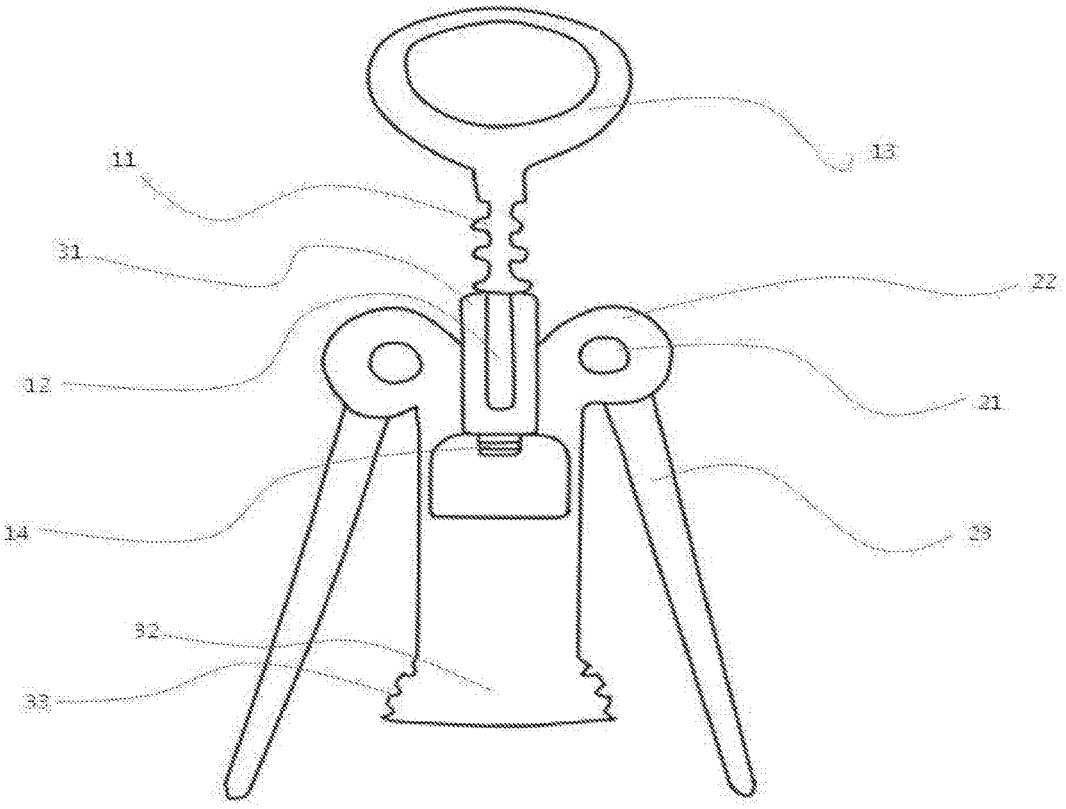
FIG. 1 is a front view of a bottle cap opener in accordance with one embodiment of the present disclosure.

For simplicity and clarity of Illustration, elements in the figures are not necessarily drawn to scale. The same reference numbers in different figures denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

DETAILED DESCRIPTIONS

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, s, operations, elements, and/or components, but do not preclude the presence or addition of one or more other features, integers, s, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Figure 2:
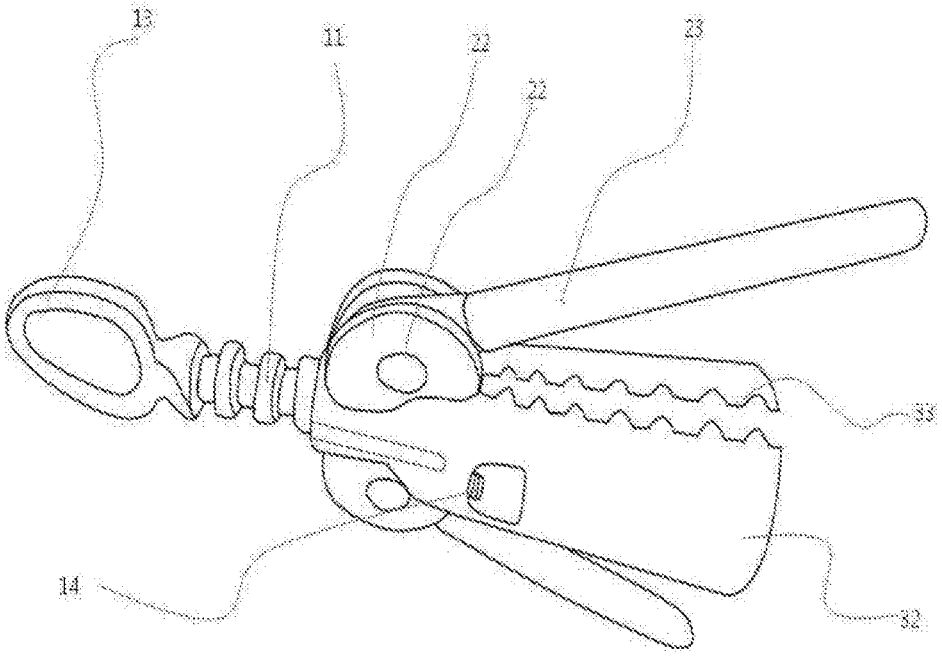
FIG. 2 is a left perspective view of a bottle cap opener in accordance with one embodiment of the present disclosure.
Figure 3:
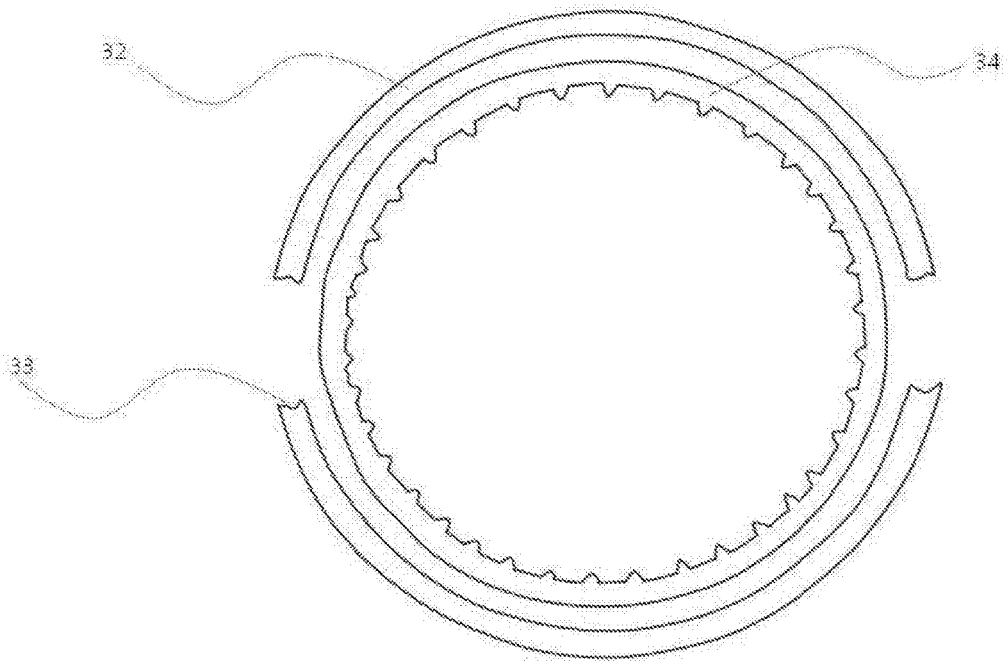
FIG. 3 is a bottom view of a bottle cap opener in accordance with one embodiment of the present disclosure.
Figure 4:
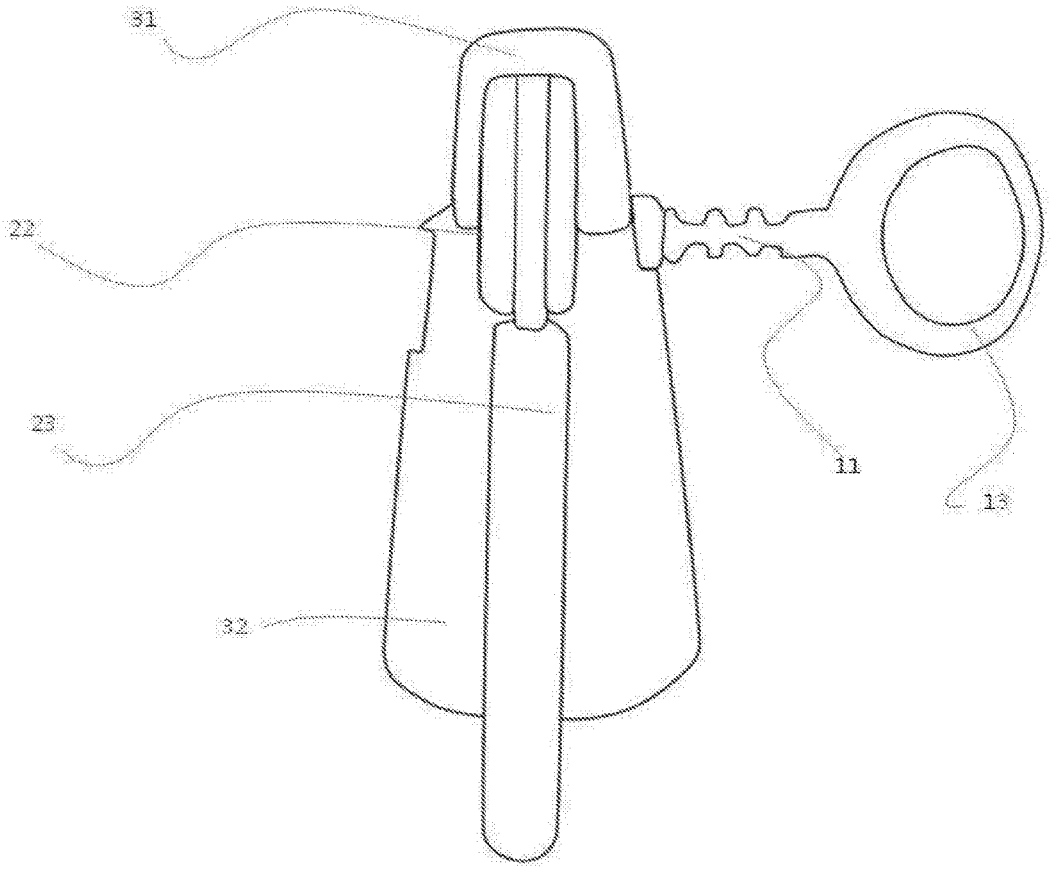
FIG. 4 is a side elevation view of a bottle cap opener when a handle has a horizontal orientation, in accordance with one embodiment of the present disclosure.
Figure 5:
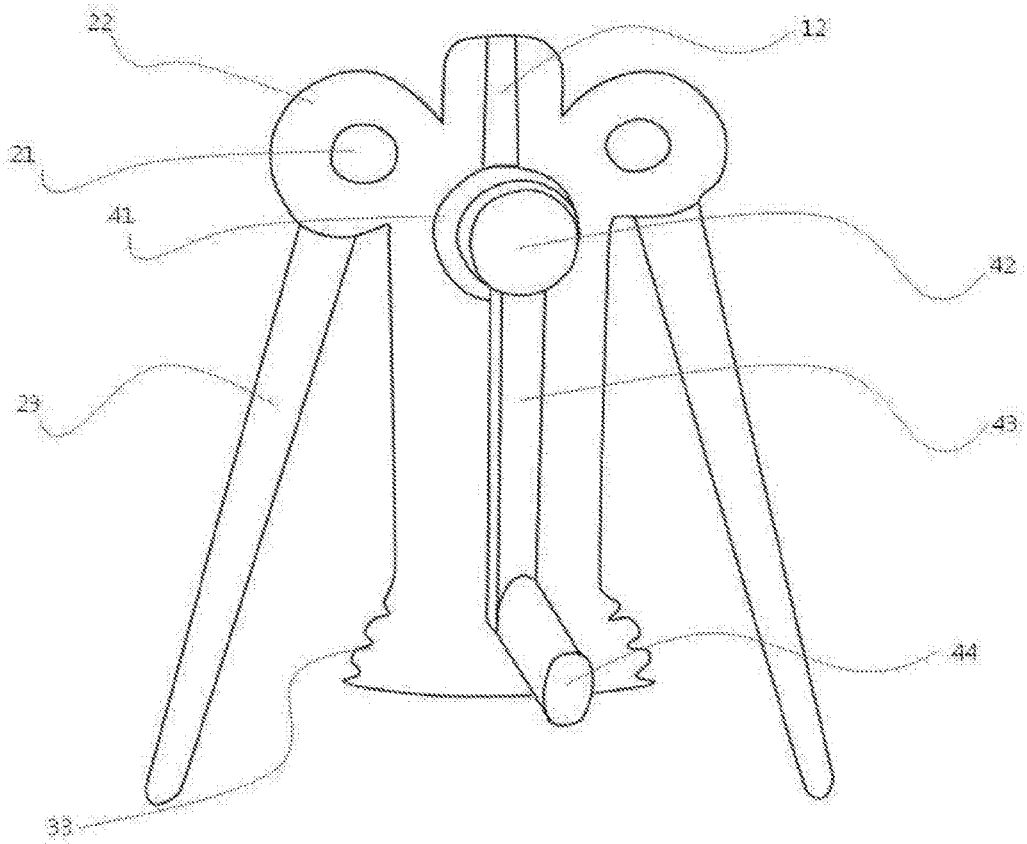
FIG. 5 is a front elevation view of a bottle cap opener when a handle has a horizontal orientation and is replaced with a L shaped handle, in accordance with one embodiment of the present disclosure.
Figure 6:
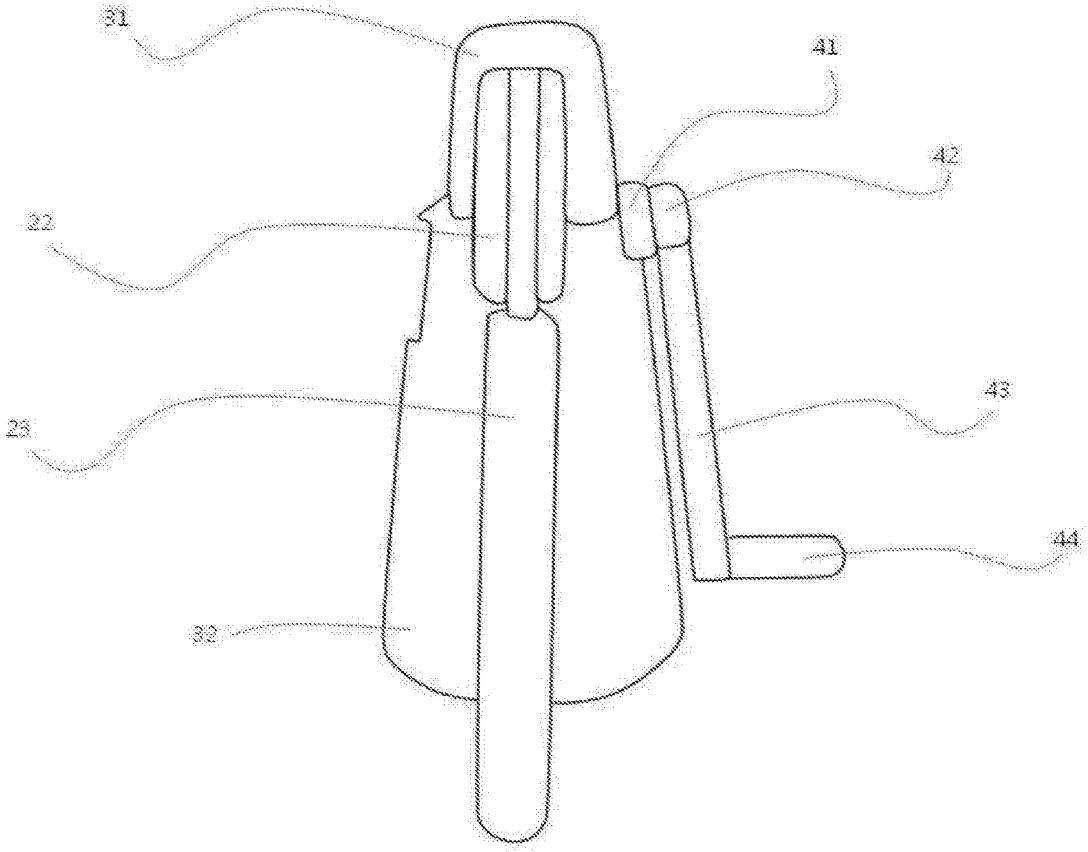
FIG. 6 is a side elevation view of a bottle cap opener when a handle has a horizontal orientation and is replaced with a L shaped handle, in accordance with one embodiment of the present disclosure.

FIG. 1 is a front view of a bottle cap opener in accordance with one embodiment of the present disclosure. FIG. 2 is a left perspective view of a bottle cap opener in accordance with one embodiment of the present disclosure. FIG. 3 is a bottom view of a bottle cap opener in accordance with one embodiment of the present disclosure. FIG. 4 is a side elevation view of a bottle cap opener when a handle has a horizontal orientation, in accordance with one embodiment of the present disclosure. FIG. 5 is a front elevation view of a bottle cap opener when a handle has a horizontal orientation and is replaced with a L shaped handle, in accordance with one embodiment of the present disclosure. FIG. 6 is a side elevation view of a bottle cap opener when a handle has a horizontal orientation and is replaced with a L shaped handle, in accordance with one embodiment of the present disclosure. Referring to FIG. 1 to FIG. 6, the present bottle cap opener will be described in details.

The present bottle cap opener may a cylindrical body including an upper cylindrical body 31 and a lower cylindrical body 32; an elongate screw bar 11 passing through the upper cylindrical body 31 at a center thereof, and passing beyond the upper cylindrical body 31 upwards; a handle 13 coupled to the elongate screw bar 11 at a top end thereof; a screw protrusion 14 coupled to the elongate screw bar 11 at a bottom end thereof; both wings 23 pivotally coupled to the upper cylindrical body 31 at both-side pivotal portions 22 thereof via both-side pivotal shafts 21 respectively; and a silicon-based cap gripper 34 formed on an inner face of the lower cylindrical body 32 so as to grip a bottle cap tightly therein. In one embodiment, the screw protrusion 14 extends in a spiral shape.

In one embodiment, the lower cylindrical body 32 is vertically divided into two lower half cylindrical bodies, wherein each of two lower half cylindrical bodies has both vertical edges with engaging convex and concave portions 33. In this way, the lower cylindrical body 32 may not slide on the cap of the bottle. In an operation, the user may rotate the handle 13 and thus the screw protrusion 14 may be fixed to the cap of the bottle. Then, the pivotal movement of the both wings 23 enables the silicon-based cap gripper 34 to grip the bottle cap tightly therein. Thus, when the user continues on rotation of the handle 13, the cap reaches the open state.

In one embodiment, the both wings 23 are configured such that the pivotal movement of the both wings 23 enables the silicon-based cap gripper 34 to grip the bottle cap tightly therein.

In one embodiment, the upper cylindrical body 31 has a handle orientation-change groove 12 defined therein, wherein an orientation of the handle 13 changes from a vertical orientation (as shown in FIG. 1) to a horizontal orientation (as shown in FIG. 4) via the handle orientation-change groove 12.

In one embodiment, when the handle 13 has the horizontal orientation, the handle 13 is replaced with a L shaped rotation handle including a horizontal portion 44 and a vertical portion 43 coupled thereto. This is shown in FIG. 5 and FIG. 6. This shaped rotation handle may rotate in a wooden pencil shaper handle. This may allow the convenience of the user.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A bottle cap opener comprising:

a cylindrical body including an upper cylindrical body and a lower cylindrical body;

an elongate screw bar passing through the upper cylindrical body at a center thereof, and passing beyond the upper cylindrical body upwards;

a handle coupled to the elongate screw bar at a top end thereof;

a screw protrusion coupled to the elongate screw bar at a bottom end thereof, the screw protrusion being configured to be fixed to a bottle cap by rotating the handle;

left and right wings pivotally coupled to the upper cylindrical body at left and right pivotal portions thereof via left and right pivotal shafts, respectively; and a silicon-based cap gripper formed on an inner face of the lower cylindrical body, wherein the left and right wings are configured such that a pivotal movement of the left and right wings enables the silicon-based cap gripper to grip the bottle cap tightly therein, thereby allowing a user to open the bottle cap easily by rotating the handle.

2. The bottle cap opener of claim 1, wherein the lower cylindrical body is vertically divided into two lower half cylindrical bodies, wherein each of two lower half cylindrical bodies has vertical edges with engaging convex and concave portions.

3. The bottle cap opener of claim 1, wherein the upper cylindrical body has a handle orientation-change groove defined therein, wherein an orientation of the handle changes from a vertical orientation to a horizontal orientation via the handle orientation-change groove.

4. The bottle cap opener of claim 3, wherein, when the handle has the horizontal orientation, the handle is replaced with a L shaped rotation handle including a horizontal portion and a vertical portion coupled thereto.

5. The bottle cap opener of claim 1, wherein the silicon-based cap gripper has a threaded inner face.

6. The bottle cap opener of claim 1, wherein the screw protrusion extends in a spiral shape.

* * * * *